US010188199B2

(12) United States Patent
Hilliard

(10) Patent No.: US 10,188,199 B2
(45) Date of Patent: Jan. 29, 2019

(54) EXTENDABLE CLEANING BRUSH

(71) Applicant: Deborah Hilliard, Waldorf, MD (US)

(72) Inventor: Deborah Hilliard, Waldorf, MD (US)

( * ) Notice: Subject to any disclaimer, the term of this patent is extended or adjusted under 35 U.S.C. 154(b) by 0 days.

(21) Appl. No.: 15/289,331

(22) Filed: Oct. 10, 2016

(65) Prior Publication Data

US 2017/0112269 A1 Apr. 27, 2017

Related U.S. Application Data

(60) Provisional application No. 62/246,241, filed on Oct. 26, 2015.

(51) Int. Cl.

| | |
|---|---|
| ***A46B 5/00*** | (2006.01) |
| ***A46B 13/04*** | (2006.01) |
| ***A46B 13/00*** | (2006.01) |
| ***A46B 5/02*** | (2006.01) |

(52) U.S. Cl.

CPC ..... *A46B 5/005* (2013.01); *A46B 5/0054* (2013.01); *A46B 5/026* (2013.01); *A46B 13/008* (2013.01); *A46B 13/04* (2013.01)

(58) Field of Classification Search

CPC ..... A46B 5/005; A46B 5/0054; A46B 13/008; A46B 13/04

See application file for complete search history.

(56) References Cited

U.S. PATENT DOCUMENTS 3,688,139 A * 8/1972 Yaguchi ..... A47L 11/38 15/29
4,674,904 A 6/1987 Buck
5,153,962 A 10/1992 Ritter
6,213,672 B1 * 4/2001 Varga ..... A47L 13/20 15/144.4
2003/0177595 A1 * 9/2003 Quach ..... A46B 13/04 15/29
2003/0213078 A1 * 11/2003 Kristofek ..... B08B 1/04 15/97.1
2004/0237228 A1 * 12/2004 King ..... A47L 11/03 15/50.1
2006/0218732 A1 * 10/2006 Standish ..... A46B 5/0095 15/24
2009/0003922 A1 1/2009 Sampaio
2014/0099154 A1 4/2014 O'Neill
(Continued)

OTHER PUBLICATIONS

Tub & Tile Multi Purpose Cordless Power Scrubber w/3 Attachments on QVC Aug. 3, 2016 https://youtu.be/h5XWTX7-pXY.

*Primary Examiner* — Randall Chin
(74) *Attorney, Agent, or Firm* — Global Intellectual Property Agency, LLC; Daniel Boudwin

(57) ABSTRACT

An extendable cleaning brush for use in cleaning hard to reach areas. The extendable cleaning brush includes an elongated handle having a first end and a second end. The elongated handle has a telescopic configuration such that it can be extended and shortened as desired. The first end includes a grip to be held by the user and one or more controls. The second end includes a housing having a rotating brush head thereon, wherein the brush head is driven by a motor disposed within the housing. A reservoir is further disposed within the housing and includes a dispensing mechanism for dispensing a cleaning solution onto the brush head. The one or more controls allow the user to actuate the motor and dispensing mechanism in a convenient manner.

9 Claims, 2 Drawing Sheets

(56) References Cited

U.S. PATENT DOCUMENTS

| | | | | |
|---|---|---|---|---|
| 2015/0082567 | A1* | 3/2015 | Perry | A47K 11/10 15/144.4 |
| 2015/0174624 | A1* | 6/2015 | Cunningham | B08B 9/0808 134/8 |
| 2017/0055692 | A1* | 3/2017 | Wobill | A46B 13/008 |

* cited by examiner

EXTENDABLE CLEANING BRUSH

CROSS REFERENCE TO RELATED APPLICATION

This application claims the benefit of U.S. Provisional Application No. 62/246,241 filed on Oct. 26, 2015. The above identified patent application is herein incorporated by reference in its entirety to provide continuity of disclosure.

BACKGROUND OF THE INVENTION

Field of the Invention

The present invention relates to a cleaning brush. More specifically, the present invention provides a cleaning brush having an extendable handle and a motorized brush head.

It is important to thoroughly and regularly clean various rooms in a home or business. Specifically, it is important to keep the bathroom clean and free from germs and bacteria. However, it can be difficult to clean certain areas within a bathroom, such as the area near or behind a toilet or inside of a bathtub. These areas can be difficult to reach using conventional cleaning tools. It can be undesirable for the user to use his or her hand and a washcloth in order to clean this area since the person is required to kneel or crawl on the floor. Other tools, such as conventional cleaning brushes provide only a short handle and still require the person cleaning to bend down or kneel on the ground. This can still be undesirable and the person may lack the proper reach to be able to clean certain areas. The user must also manually move the cleaning brush or tool back and forth in order to clean, which can be labor intensive and tiresome. Thus, an improved cleaning device for use in cleaning various areas is desired.

Devices have been disclosed in the prior art that relate to cleaning brushes. These include devices that have been patented and published in patent application publications. These devices generally relate to cleaning brushes having means for dispensing a solution therefrom, such as U.S. Pat. No. 4,674,904, U.S. Pat. No. 5,153,962, U.S. Published Patent Application Number 2009/0003922, and U.S. Published Patent Application Number 2014/0099154.

These prior art devices have several known drawbacks. The devices in the prior art fail to provide a cleaning brush having an extendable handle that allows the user to reach hard to reach areas from a standing position and that can be retracted to a shortened configuration for use as desired. Further, the devices in the prior art fail to provide motorized brush heads that allow for easier cleaning of surfaces and objects.

In light of the devices disclosed in the prior art, it is submitted that the present invention substantially diverges in design elements from the prior art and consequently it is clear that there is a need in the art for an improvement to existing cleaning brush devices. In this regard the instant invention substantially fulfills these needs.

SUMMARY OF THE INVENTION

In view of the foregoing disadvantages inherent in the known types of cleaning brushes now present in the prior art, the present invention provides a new cleaning brush wherein the same can be utilized for providing convenience for the user when cleaning hard to reach areas without having to bend over or kneel on the ground.

The present invention provides an extendable cleaning brush. The cleaning brush comprises an elongated handle having a first end and a second end, wherein the elongated handle has a telescopic configuration. The first end of the handle comprises a grip thereon with one or more controls. The second end includes a housing with a rotatable cleaning head thereon, wherein the brush head is preferably driven by a motor disposed within the housing. Further, a reservoir is positioned within the housing and includes a dispensing mechanism with a fluid outlet disposed on the brush head such that cleaning solution in the reservoir can be dispensed onto the brush head. The one or more controls on the handle allow the user to easily operate the motorized brush head and the dispensing mechanism.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
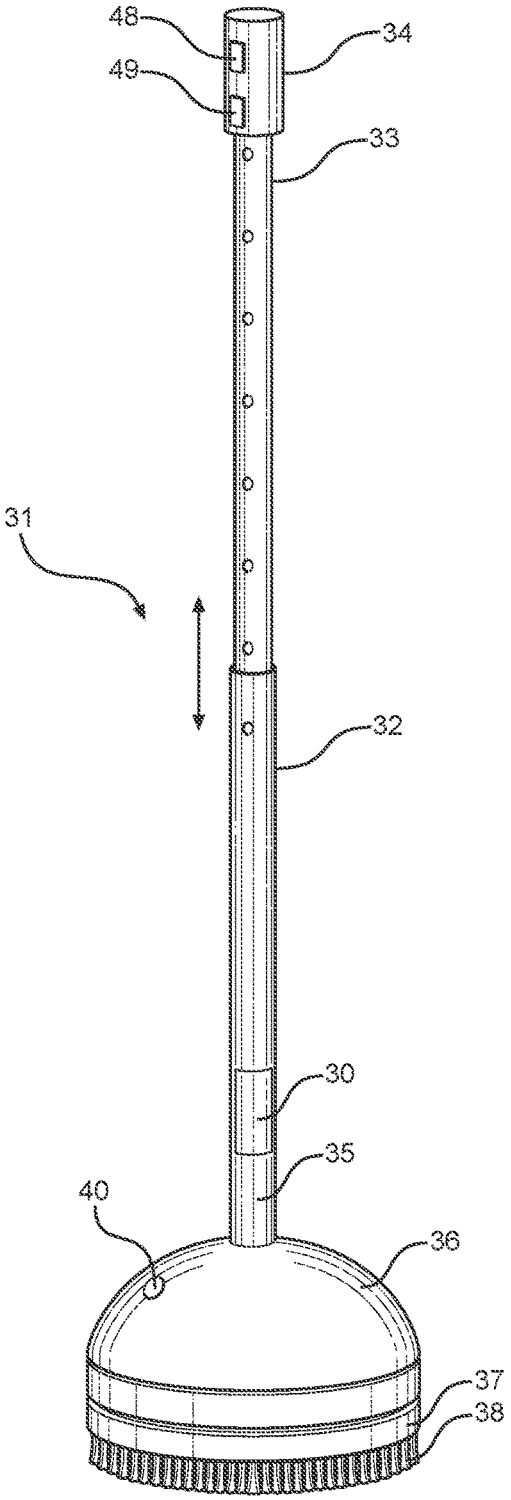
FIG. 1A shows a perspective view of the extendable cleaning brush with the handle in an extended configuration.

Reference is made herein to the attached drawings. Like reference numerals are used throughout the drawings to depict like or similar elements of the extendable cleaning brush. For the purposes of presenting a brief and clear description of the present invention, the preferred embodiment will be discussed as used for cleaning floor surfaces. The figures are intended for representative purposes only and should not be considered to be limiting in any respect.

Figure 1B:
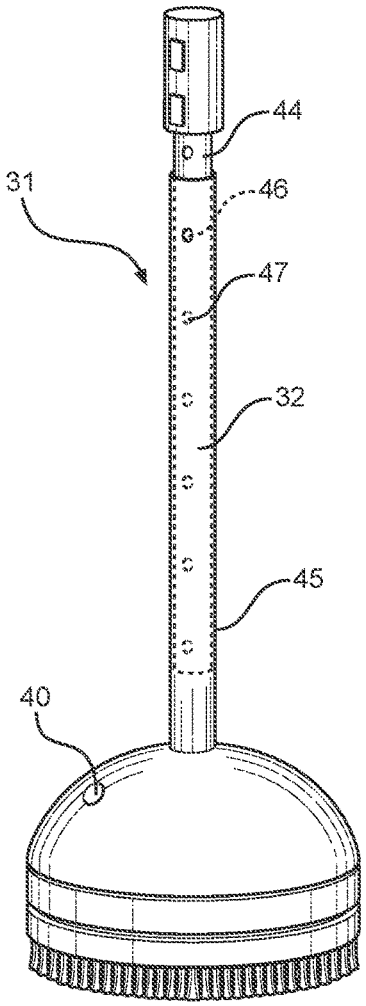
FIG. 1B shows a perspective view of the extendable cleaning brush with the handle in a shortened configuration.

Referring now to FIGS. 1A and 1B, there are shown perspective views of the extendable cleaning brush in an extended configuration and in a shortened configuration, respectively. The extendable cleaning brush 31 comprises a handle 32 having a first end 33 and a second end 35, wherein the handle 32 can be adjusted in length. The handle 32 preferably comprises a first section and a second section slidably disposed within the first section such that the second section can be extended from and retracted into the first section. In the shown embodiment, the telescopic configuration is such that it includes an outer tube 45 having an inner tube 44 movably positioned therein, wherein the inner tube 44 can be extended from the outer tube 45 to lengthen the handle 32 or retracted into the outer tube 45 to shorten the handle 32.

The handle 32 comprises a locking mechanism thereon for maintaining the inner tube 44 in a fixed position relative to the outer tube 45 once the handle 32 has been extended to the desired length. In the illustrated embodiment, the inner tube 44 comprises a series of apertures 47 spaced at fixed intervals along the length thereof. The apertures 47 can be aligned with an aperture 46 on the outer tube 45 and a pin or other fastener can be inserted therein so as to secure the inner tube 44 in a fixed position relative to the outer tube 45. In other embodiments, the locking mechanism comprises a spring detent that can engage an aperture 46 on the outer tube 45.

The first end 33 of the handle 32 further comprises a grip 34 thereon. The grip 34 comprises a textured or padded area on the handle 32 that allows the user to more easily and comfortably hold the handle 32. The grip 34 may be composed of rubber, silicone or other similar material. The grip 34 is preferably composed of a high-friction or non-slip material that prevents the user's hand from slipping while holding the handle 32.

The second end 35 of the handle 32 comprises a housing 36 thereon. The housing 36 includes a rotating brush head 37 thereon that is adapted to engage a surface for cleaning. The brush head 37 comprises a base on which a plurality of bristles 38 are mounted. Preferably, the brush head 37 comprises a circular or disk shape. In one embodiment, the rotating brush head 37 is operably connected to a power source, such as a rechargeable battery positionable within a battery compartment 30. In the shown embodiment, the battery compartment 30 is disposed on the handle 32 of the extendable cleaning brush 31. However in alternative embodiments, the battery compartment 30 is disposed in the brush head 37.

Figure 2:
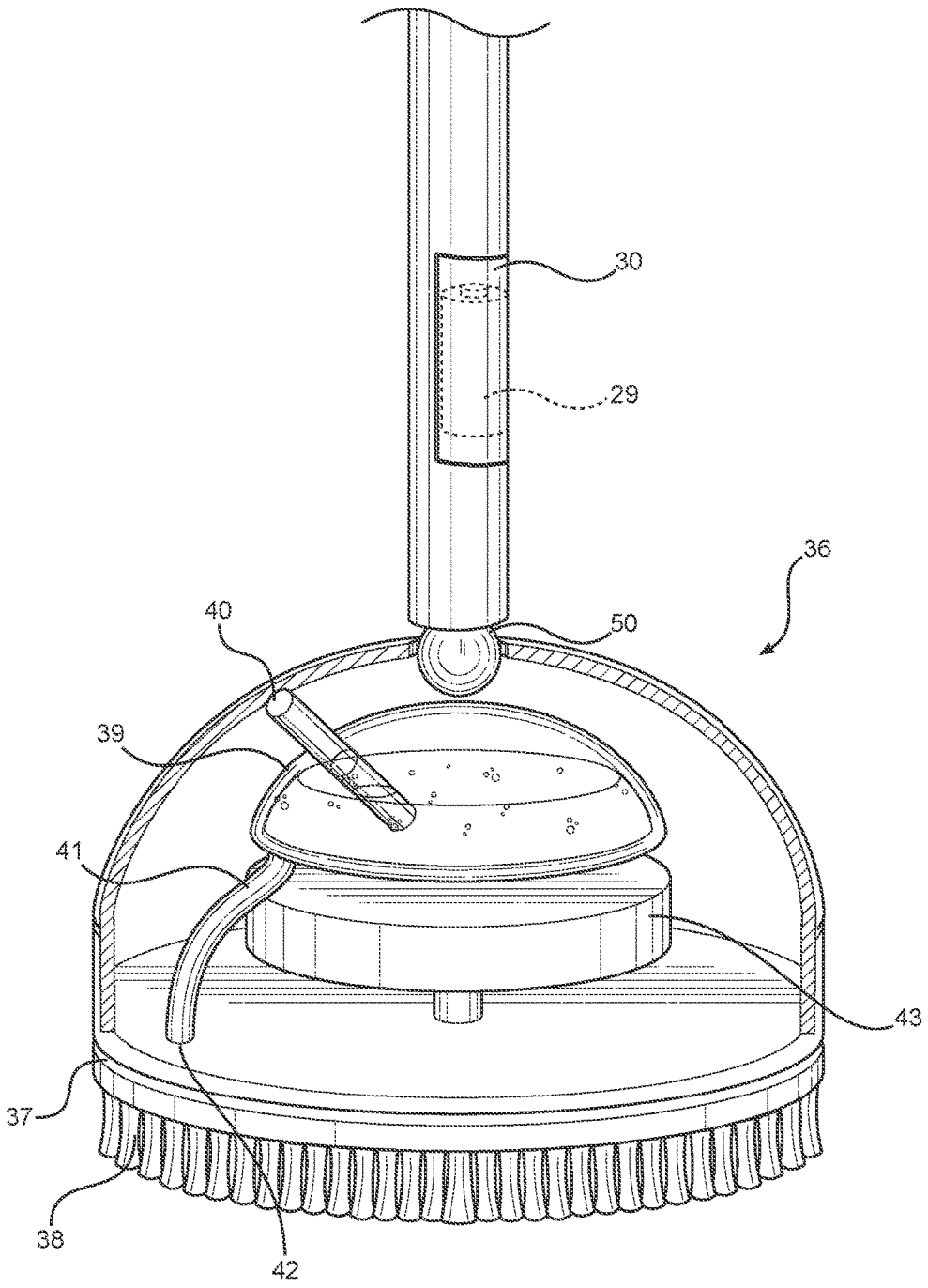
FIG. 2 shows a transparent view of the housing of the extendable cleaning brush.

Referring now to FIG. 2, there is shown a transparent view of the housing of the extendable cleaning brush. In some embodiments, the brush head 37 is driven by a motor 43 so that the brush head 37 rotates in a circular motion. This provides a scrubbing effect so that the user does not have to move the extendable cleaning brush back and forth in order to scrub a surface. The housing 36 is attached to the handle via a joint 50 that allows the housing 36 to pivot or swivel relative to the handle. Preferably, the joint 50 comprises a ball and socket joint so as to allow for rotation in 360 degrees. This allows the brush head to contour to angle surfaces and more easily clean various areas. Further, the battery 29 is removably positioned within the battery compartment 30, wherein the battery 29 provides electrical power to the motor 43.

The housing 36 further includes a reservoir 39 in which a cleaning solution can be stored for dispensing. The housing 36 comprises an opening 40 thereon that provides access to the reservoir 39 so that the user can refill the reservoir when the cleaning solution has been fully used. A dispensing mechanism 41 can be actuated in order to selectively release a fixed amount of the cleaning solution. The dispensing mechanism 41 comprises an outlet 42 on the brush head 37 so as to provide the cleaning solution to the bristles 38 thereon. Preferably, a control is positioned on the handle of the extendable cleaning brush, wherein the user can operate the control in order to cause the dispensing mechanism 41 to dispense a volume of the cleaning solution from the cleaning reservoir 39.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable cleaning brush, comprising:

an elongated handle having a first end and a second end, wherein the elongated handle has a telescopic construction;

the second end of the handle having a housing therein, wherein a brush head having a plurality of bristles is connected to the housing;

a reservoir operably connected to a dispensing mechanism adapted to selectively release a quantity of a cleaning solution stored within the reservoir;

wherein the dispensing mechanism comprises a tube that extends from the reservoir to a lower surface of the brush head such that the cleaning solution is dispensed onto the brush head;

wherein the elongated handle is affixed to the housing via a ball and socket joint at a center region, wherein the ball and socket joint is configured to freely rotate the housing thereabout;

wherein the housing is a hemisphere.

2. The extendable cleaning brush of claim 1, wherein the elongated handle comprises a first section and a second section slidably disposed within the first section such that the second section can be extended from and retracted into the first section.

3. The extendable cleaning brush of claim 1, wherein the handle comprises a pin-locking mechanism adapted to secure the handle at a fixed length.

4. The extendable cleaning brush of claim 1, wherein the brush head is operably connected to a motor adapted to drive the brush head in a rotating motion, wherein the motor is enclosed within the housing.

5. The extendable cleaning brush of claim 4, wherein the handle comprises a battery compartment configured to receive a battery, wherein the battery is operably connected to the motor.

6. The extendable cleaning brush of claim 1, wherein the brush head comprises a disk having a plurality of bristles extending therefrom.

7. The extendable cleaning brush of claim 1, further comprising one or more controls disposed on the handle that are operably connected to the dispensing mechanism.

8. The extendable cleaning brush of claim 1, wherein an opening disposed on the housing is in fluid communication with the reservoir, wherein the opening is configured to fill the reservoir with a cleaning solution.

9. The extendable cleaning brush of claim 1, wherein the reservoir is entirely disposed within the housing.

* * * * *